US005565635A

United States Patent [19]

Kaneko et al.

[11] Patent Number: 5,565,635

[45] Date of Patent: Oct. 15, 1996

[54] AUTOMATIC PLAYING APPARATUS WITH PEDAL ACTUATORS SUPPORTED BY BRACKET INDEPENDENT OF CASE OF ACOUSTIC PIANO

[75] Inventors: Yasutoshi Kaneko; Kiyoshi Kawamura, both of Shizuoka-ken, Japan

[73] Assignee: Yamaha Corporation, Japan

[21] Appl. No.: 317,754

[22] Filed: Oct. 4, 1994

[30] Foreign Application Priority Data

Oct. 8, 1993 [JP] Japan ..... 5-59800 U

[51] Int. Cl.[6] ..... G10C 3/20; G10C 3/26; G10F 1/02; G10F 5/02

[52] U.S. Cl. ..... 84/20; 84/115; 84/225; 84/246

[58] Field of Search ..... 84/601, 602, 609–614, 84/19–23, 115, 225, 229, 244, 246, DIG. 7

[56] References Cited

U.S. PATENT DOCUMENTS

| | | | |
|---|---|---|---|
| 893,710 | 7/1908 | Crippen . | |
| 1,504,531 | 8/1924 | Thomson et al. . | |
| 4,206,677 | 6/1980 | Ramsey . | |
| 4,216,694 | 8/1980 | Ramsey et al. . | |
| 4,469,000 | 9/1984 | Fujiwara et al. | 84/115 |
| 4,744,281 | 5/1988 | Isozaki | 84/602 |
| 4,843,936 | 7/1989 | Murakami et al. . | |
| 5,166,467 | 11/1992 | Brown | 84/721 X |
| 5,357,046 | 10/1994 | Matsui et al. | 84/609 |
| 5,376,751 | 12/1994 | Narita | 84/609 |

*Primary Examiner*—Stanley J. Witkowski
*Attorney, Agent, or Firm*—Graham & James LLP

[57] ABSTRACT

An automatic playing apparatus is provided for an acoustic piano for reproducing a music without fingering of a player on a keyboard, and has a pedal actuator unit directly supported by a floor so that a reaction of the pedal is never exerted to the piano case, thereby preventing the key bed from deformation due to the reaction.

6 Claims, 4 Drawing Sheets

AUTOMATIC PLAYING APPARATUS WITH PEDAL ACTUATORS SUPPORTED BY BRACKET INDEPENDENT OF CASE OF ACOUSTIC PIANO

FIELD OF THE INVENTION

This invention relates to an automatic playing apparatus and, more particularly, to an automatic for selectively depressing black and white keys in an automatic reproduction of a music.

DESCRIPTION OF THE RELATED ART

A typical example of the automatic playing apparatus is provided for an upright piano 1, and comprises a controller 2 accommodated in a stool 1*a*, a key actuator unit 3 placed over a keyboard 1*b* of the upright piano 1, a pedal actuator unit 4 detachably connected to a lower surface of a key bed 5 and a harness 6 connected between the controller 2, and the key and pedal actuator units 3 and 4.

The controller 2 has a manipulating panel 2*a* exposed to a front surface of the stool 1*a* and a slot 2*b* for loading a floppy disk into a floppy disk driver. The floppy disk stores a series of digital music data codes indicative of a performance on a keyboard. Though not shown in FIG. 1, a data processing sub-system is incorporated in the controller 2, and sequentially fetches the music data codes for producing drive pulse signals.

The key actuator unit 3 comprises a plurality of electromagnetic actuators 3*a* housed in a casing 3*b*, and the plurality of electromagnetic actuators 3*a* are respectively associated with a plurality of black and white keys 1*c* forming the keyboard 1*b*. As will be seen from FIG. 2, each of the electromagnetic actuators 3*a* is implemented by a combination of a solenoid coil 3*c* wound on a cylindrical bobbin 3*d*, a plunger 3*e* slidable in the cylindrical bobbin 3*d* and a return spring 3*f* upwardly urging the plunger 3*e*.

When the drive pulse signal is supplied from the controller 2 through the harness 6 to the solenoid coil 3*c*, the plunger 3*e* downwardly projects from the cylindrical bobbin 3*d*, and pushes down the associated key 1*c* as if a player depresses the key 1*c*. While the controller is sequentially supplying the drive pulse signals to the electromagnetic actuators 3*a*, the black and white keys 1*c* are selectively depressed by the plungers 3*e*, and the music is reproduced by the upright piano 1.

Turning back to FIG. 1, the pedal actuator unit 4 is also implemented by electromagnetic actuators housed in a casing 4*a*, and each of the electromagnetic actuators of the pedal actuator unit 4 is similar to that shown in FIG. 2. The casing 4*a* is hung through rigid rods 4*b* from the lower surface of the key bed 5, and the rigid rods 4*b* are detachably connected to the lower surface of the key bed 5.

The electromagnetic actuators of the pedal actuator unit 4 are also connected through the harness 6 to the controller 2, and the controller 2 supplies the drive pulse signals to the solenoid coils of the actuators during the performance. Then, the electromagnetic actuators push down the pedals of the upright piano, and spices the performance.

A problem is encountered in the prior art automatic playing apparatus in that gaps take place between some keys 1*c* and the leading ends of the plungers 3*e*, and the automatic playing apparatus does not exactly reproduce a music.

A piano equipped with a built-in automatic playing apparatus encounters the same problem.

SUMMARY OF THE INVENTION

It is therefore an important object of the present invention to provide an automatic playing apparatus which exactly reproduces a music.

The present inventors contemplated the problem, and noticed that the key bed was gradually deformed. The present inventors concluded that the deformation of the key bed was resulted from the reaction of the electromagnetic actuators of the pedal actuator unit 4.

To accomplish the object, the present invention proposes to support a pedal actuator unit independently from a case of an acoustic piano.

In accordance with the present invention, there is provided an automatic playing apparatus associated with an acoustic piano having a plurality of keys each movable from a rest position toward an end position for causing music strings to produce an acoustic sound, pedal mechanisms for imparting effects to the acoustic sound and a piano case for accommodating the plurality of keys and the pedal mechanisms, comprising: a) a key actuator unit having a plurality of solenoid-operated actuators respectively associated with the plurality of keys for moving the associated keys; b) a pedal actuator unit having a plurality of solenoid-operated actuators respectively associated with the pedal mechanisms for actuating the associated pedal mechanisms, and supported by a frame independent of the piano case; and c) a controller unit operative to produce drive pulse signals, and selectively supplying the drive pulse signals to the plurality of solenoid-operated actuators of the key actuator unit and the plurality of solenoid-operated actuators of the pedal actuator unit.

BRIEF DESCRIPTION OF THE DRAWINGS

The feature and advantages of the automatic playing apparatus according to the present invention will be more clearly understood from the following description taken in conjunction with the accompanying drawings in which.

DESCRIPTION OF THE PREFERRED EMBODIMENTS

First Embodiment

Figure 3:
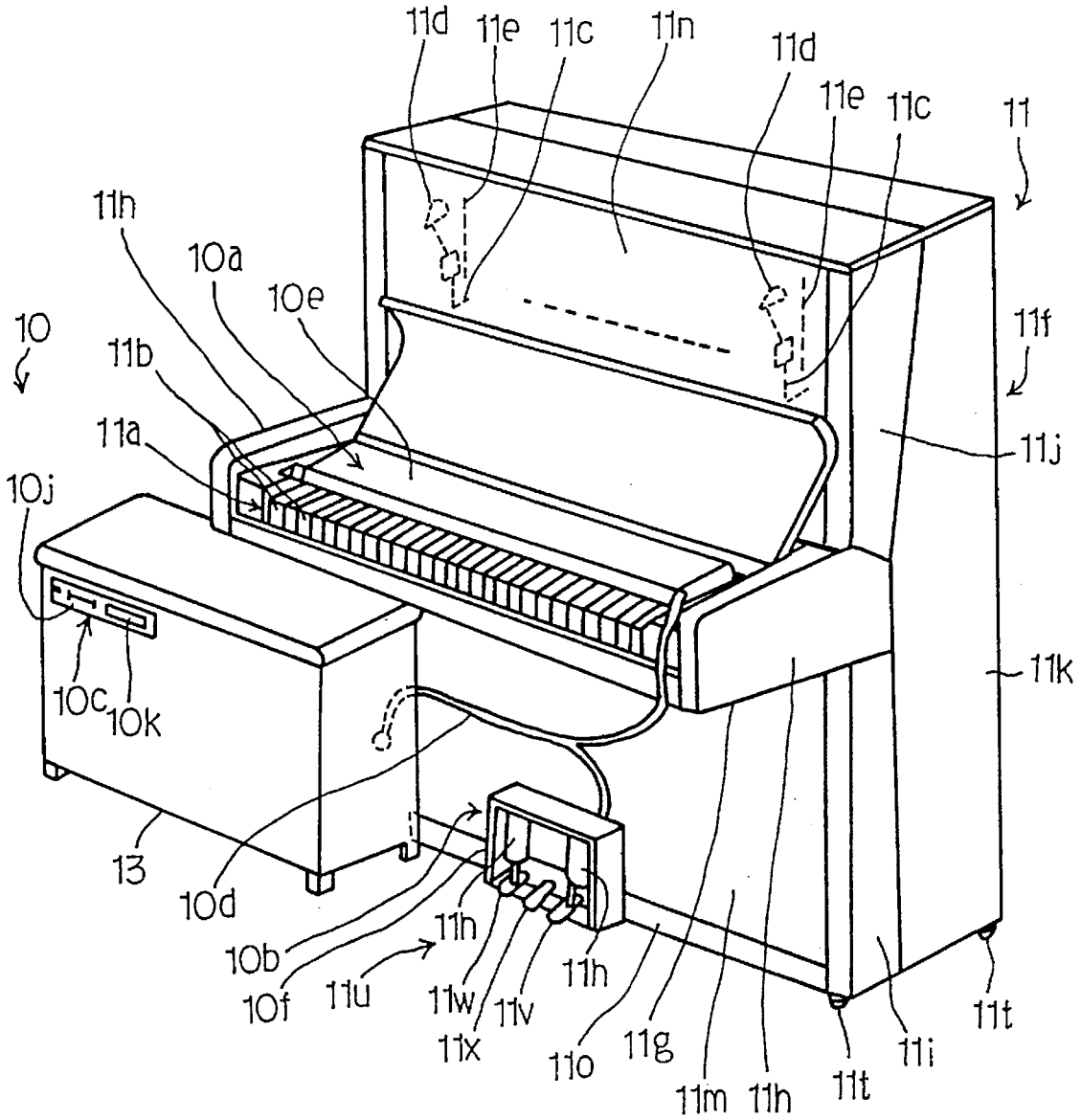
FIG. 3 is a perspective view showing an automatic playing apparatus according to the present invention together with an upright piano.

Referring to FIG. 3 of the drawings, an automatic playing apparatus 10 embodying the present invention is provided for an upright piano 11, and is assembled with the upright piano 11 for reproducing a music.

The upright piano 11 is a standard upright piano, and comprises a keyboard 11*a* implemented by black and white keys 11*b*, key action mechanisms 11*c* respectively linked with the black and white keys 11*b*, hammer assemblies 11*d* driven for rotation by the respective key action mechanisms 11*c* and sets of music wires 11*e* struck by the hammer assemblies 11*d*, respectively. When one of the back and white keys 11*b* is depressed, the key action mechanism 11*c* starts the action, and rotates the hammer assembly 11*d* for striking the set of music wires. The key action mechanism 11*c* and the hammer assembly 11*d* are well known to a person skilled in the art, and no further description is incorporated hereinbelow.

The key action mechanisms 11*c*, the hammer assemblies 11*d* and the sets of music wires 11*e* are accommodated in an inner space of a piano case 11*f*, and the piano case 11*f* has a key bed 11*g*, a side arms 11*h* fixed to both sides of the key bed 11*g*, leg posts 11*i* supporting the side arms 11*h*, upper leg posts 11*j* upwardly projecting from the side arms 11*h*, side boards 11*k* connected to the leg posts 11*i* and 11*j*, a front lower board 11*j* extending between the leg posts 11*i*, an upper front board 11*n* extending between the upper leg posts 11*j* for covering the key action mechanisms 11*c*, the hammer assemblies 11*d* and the sets of music wires 11*e* and a bottom sill 11*o* attached to the lower edge of the lower front board 11*m*.

Figure 4:
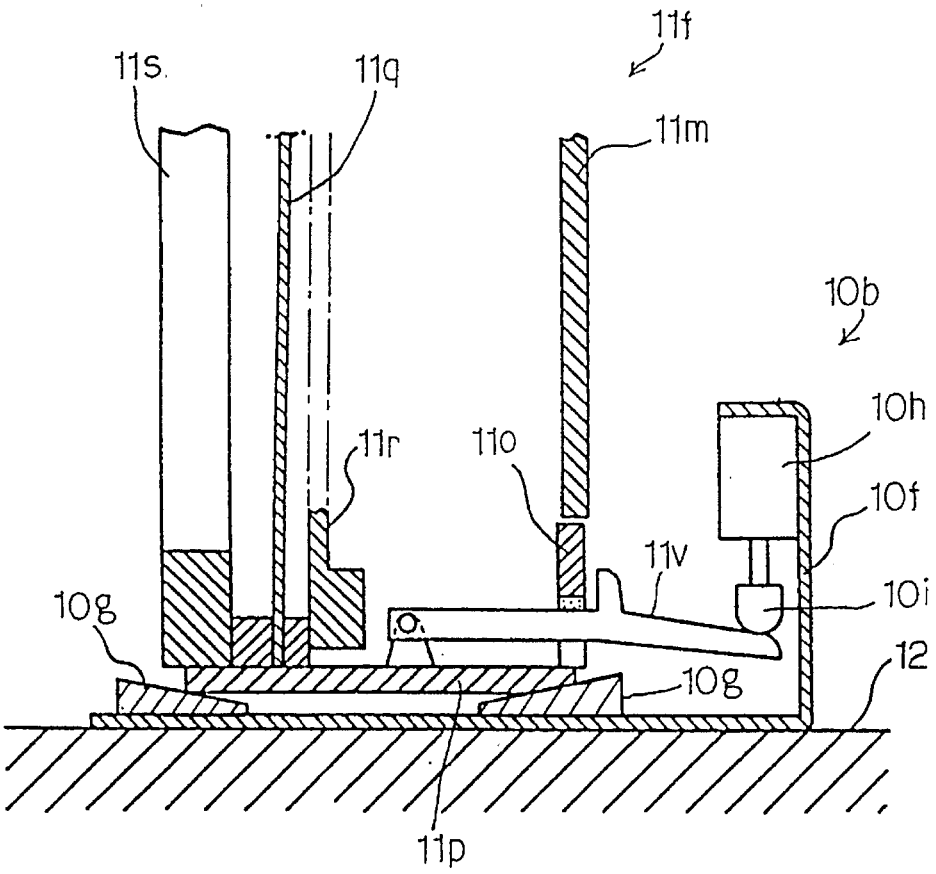
FIG. 4 is a cross sectional view showing a pedal actuator unit incorporated in the automatic playing apparatus.

As will be seen from FIG. 4 of the drawings, the piano case 11*f* further comprises a bottom board 11*p* defining the lowest edge of the inner space, a sound board 11*q* extending between the side boards 11*k* and defining the rear edge of the inner space, a frame 11*r* for the sets of music wires 11*e* and posts 11*s* reinforcing the piano case 11*f*. The keyboard 11*a*, the key action mechanisms 11*c*, the hammer assemblies 11*d* and the music wires 11*e* are supported by the piano case 11*f*, and the piano case 11*f* in turn is supported through casters 11*t* by a floor 12.

Turning back to FIG. 3, the upright piano further comprises pedal mechanisms 11*u* for imparting effects to acoustic sounds produced by the music wires 11*e*, and the pedal mechanisms 11*u* are respectively coupled to a damper pedal 11*u*, a soft pedal 11*w* and a sostenuto pedal 11*x*. These pedals 11*v*, 11*w* and 11*x* are outwardly project from the bottom sill 11*o*, and are independently turnable for actuating the pedal mechanisms 11*u*. The structure and the functions of these pedal mechanisms 11*u* are known to a person skilled in the art, and detailed description is omitted for the sake of simplicity.

The automatic playing apparatus 10 is largely broken down into three units, i,e., a key actuator 10*a*, a pedal actuator 10*b* and a controller 10*c*, and a harness 10*d* is connected between the controller 10*c* and the actuator units 10*a* and 10*b*.

Figure 1:
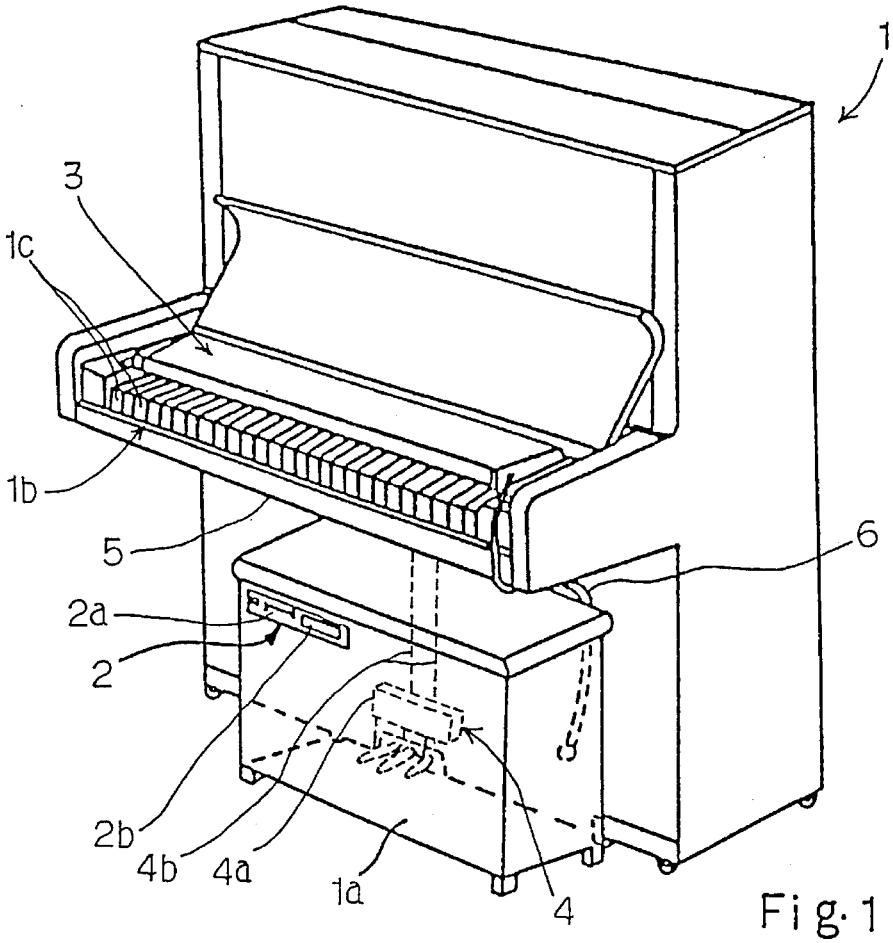
Fig. 1 PRIOR ART
FIG. 1 is a perspective view showing the prior art automatic playing apparatus together with the upright piano.
Figure 2:
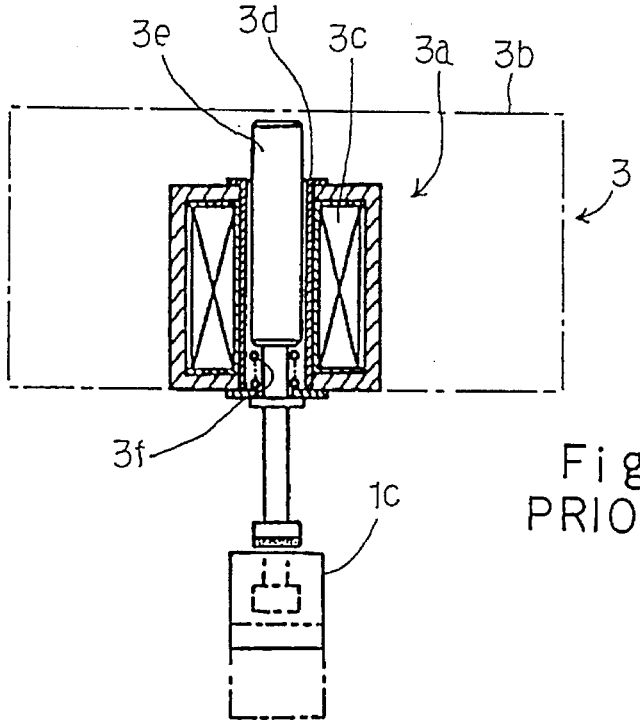
Fig. 2 PRIOR ART
FIG. 2 is a cross sectional view showing the electromagnetic actuator incorporated in the prior art automatic playing apparatus.

The key actuator unit 10*a* has a plurality of solenoid-operated actuators each similar to the electromagnetic actuator shown in FIG. 2 and a casing 10*e* accommodating the solenoid-operated actuators and holding them over the keyboard 11*a*. The solenoid-operated actuators of the key actuator unit 10*a* are respectively associated with the black and white keys 11*b*, and depress the associated keys 11*b* while the controller is energizing.

Figure 5:
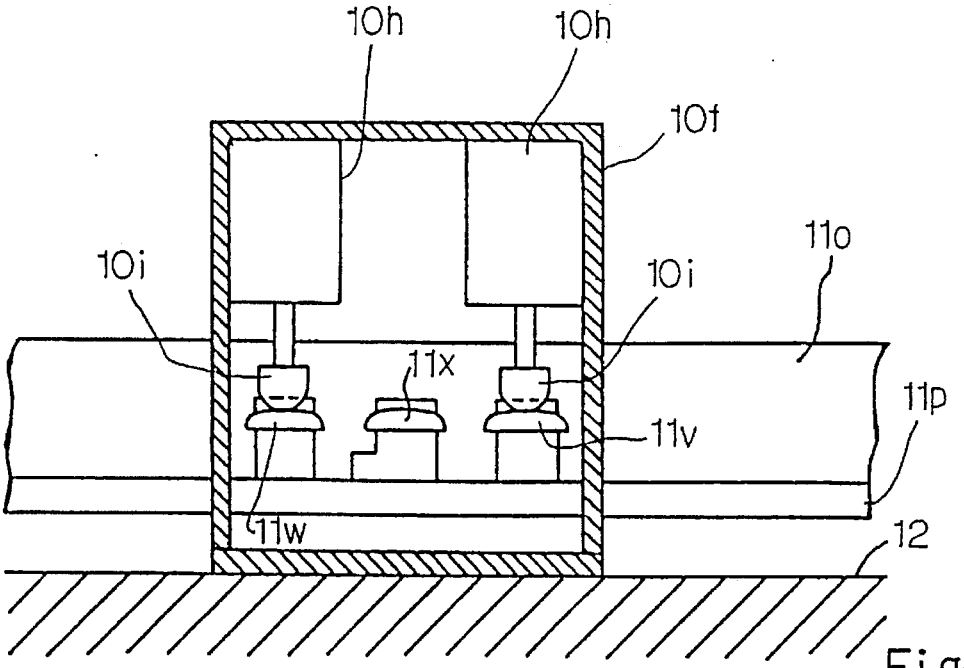
FIG. 5 is a front view showing the pedal actuator unit.

Turning to FIGS. 4 and 5 of the drawings, the pedal actuator unit 10*b* comprises a frame 10*f* directly placed on the floor 12, a pair of wedge members 10*g* inserted between the bottom board 11*p* and the frame 10*f* and a plurality of solenoid-operated actuators 10*h* supported by the frame 10*f*.

The solenoid-operated actuators 10*h* have respective plungers, and pushers 10*i* are attached to the leading ends of the plungers. The pushers 10*i* are held in contact with the damper and soft pedals 11*v* and 11*w*, and the solenoid-operated actuators 10*h* independently push down the damper and soft pedals 11*v* and 11*w* when the controller 10*c* selectively energizes the solenoid-operated actuators 10*h*. The wedge members 10*g* strongly press the frame 10*f* against the floor 12 due to the weight of the upright piano, and the weight of the pedal actuator unit 10*b* are not exerted on the piano case 11*f*. This results in that the reaction of each pedal 11*v*/11*w* is directly applied to the floor 12 without transfer to the piano case 11*f*. For this reason, the reaction does not deform any member of the piano case 11*f*, and the solenoid-operated actuators of the key actuator unit 10*a* exactly maintain regulated relative positions to the black and white keys 11*b*.

In this instance, the solenoid-operated actuators 10*h* are associated with the damper and soft pedals 11*v* and 11*w* only. However, the solenoid-operated actuators 10*h* may be provided for all of the three pedals 11*v*, 11*w* and 11*x*.

Turning back to FIG. 3, the controller 10*c* has a manipulating panel 10*j* exposed to a front surface of a stool 13 and a slot 10*k* for loading a floppy disk into a floppy disk driver incorporated in the controller 10*c*. The floppy disk stores a series of digital music data codes indicative of a performance on a keyboard. Though not shown in FIG. 3, a data processing sub-system is further incorporated in the controller 10*c*, and sequentially fetches the music data codes for producing the drive pulse signals. The drive pulse signals are supplied from the data processing sub-system through the harness 10*d* to the key and pedal actuator units 10*a* and 10*b*, and the key and pedal actuator units 10*a* and 10*b* distribute the drive pulse signals to the solenoid-operated actuators. When the drive pulse signal is supplied from the controller 10*c* through the harness 10*d* to the solenoid-operated actuator, the plunger downwardly projects from the cylindrical bobbin, and pushes down the associated key 11*b* or the associated pedal 11*v*/11*w* as if a player depresses it.

While the controller 10*c* is sequentially supplying the drive pulse signals to the solenoid-operated actuators of the key actuator unit 10*a* and the solenoid-operated actuators 11*h* of the pedal actuator unit 10*b*, the black and white keys 11*b* and the pedals 11*v*/11*w* are selectively depressed, and the music is reproduced by the upright piano 11.

When one of the solenoid-operated actuators 11*h* depresses the associated pedal 11*v*/11*w*, the reaction against the solenoid-operated actuator 11*h* ranges from 5 kilograms to 10 kilograms. The reaction is transferred to the frame 10*f*, and pushes down the floor 12. However, the reaction is never applied to the piano case 11*f*, and the key bed 11*g* is free from the reaction.

As will be understood from the foregoing description, the pedal actuator 10*b* according to the present invention is directly supported by the floor 12, and a reaction at the pedal depressing is never exerted to the piano case 11*f*. For this reason, the key bed 11*g* is never deformed, and the key actuator unit 10*a* depresses the black and white keys 11*b* at expected timings. This results in faithful reproduction of a music.

Second Embodiment

Figure 6:
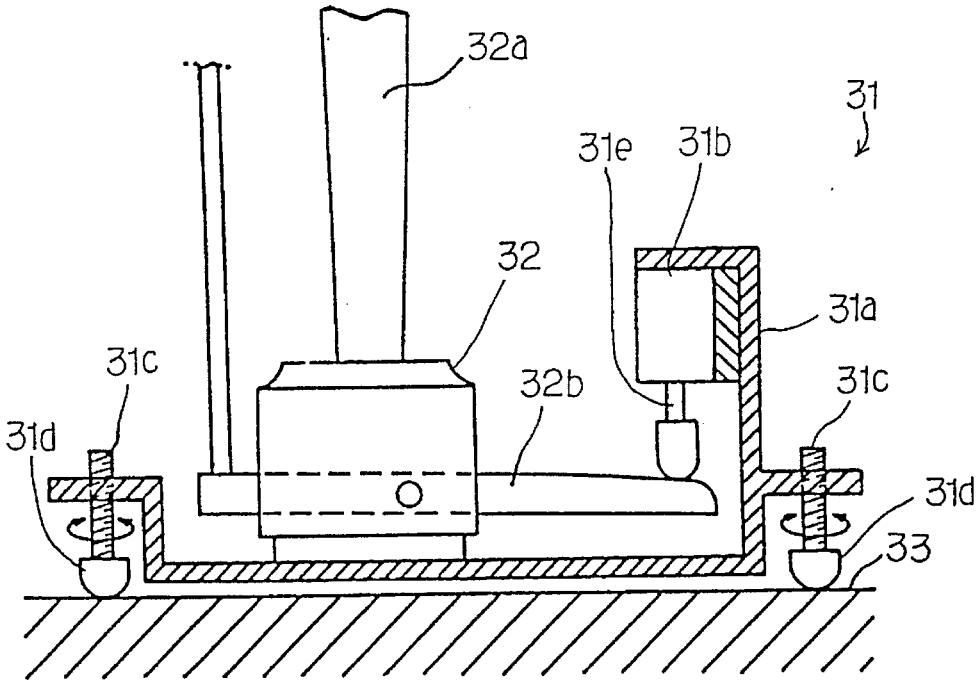
FIG. 6 is a cross sectional side view showing a pedal actuator unit incorporated in another automatic playing apparatus according to the present invention provided for a grand piano.

Turning to FIG. 6 of the drawings, another pedal actuator unit 31 is illustrated together with a pedal box 32 of a grand piano. The pedal box 32 is supported by a lyre post 32*a*, and pedals 32*b* are turnably supported by the pedal box 32. The grand piano further comprises a keyboard, key action mechanisms, hammer mechanisms and sets of strings. However, description is omitted, because they are analogous to those of the upright piano.

The pedal actuator unit 31 forms a part of an automatic playing apparatus embodying the present invention together with a key actuator unit for the keyboard and a controller coupled through a harness with the key actuator unit and the pedal actuator unit 31. The key actuator unit and the controller are similar to those of the first embodiment, and no further description is incorporated hereinbelow.

The pedal actuator unit 31 comprises a frame 31*a* extending beneath the pedal box 32, a plurality of solenoid-operated actuators 31*b* hung from the upper portion of the frame 31*b* and screws 31*c* engaged with the frame 31*a*. Cushion members 31*d* are attached to the leading ends of the screws 31*c*, and are held in contact with a floor 33.

The screws press the cushion members 31*d* against the floor 33, and the cushion members 31*d* lift the screws 31*c* and the frame 31*a*. As a result, the frame 31*a* is pressed against the bottom surface of the pedal box 32, and a relative motion between the frame 31*a* and the pedal box 32 is not allowed.

When the solenoid-operated actuators 31*b* is being energized, the plungers 31*e* depress the associated pedals 32*b*, and the reactions are received by the floor 33. For this reason, the reaction is never directly exerted on the piano case of the grand piano, and the key bed is not deformed by the reaction. The automatic playing apparatus implementing the second embodiment achieves all of the advantages of the first embodiment.

Third Embodiment

Figure 7:
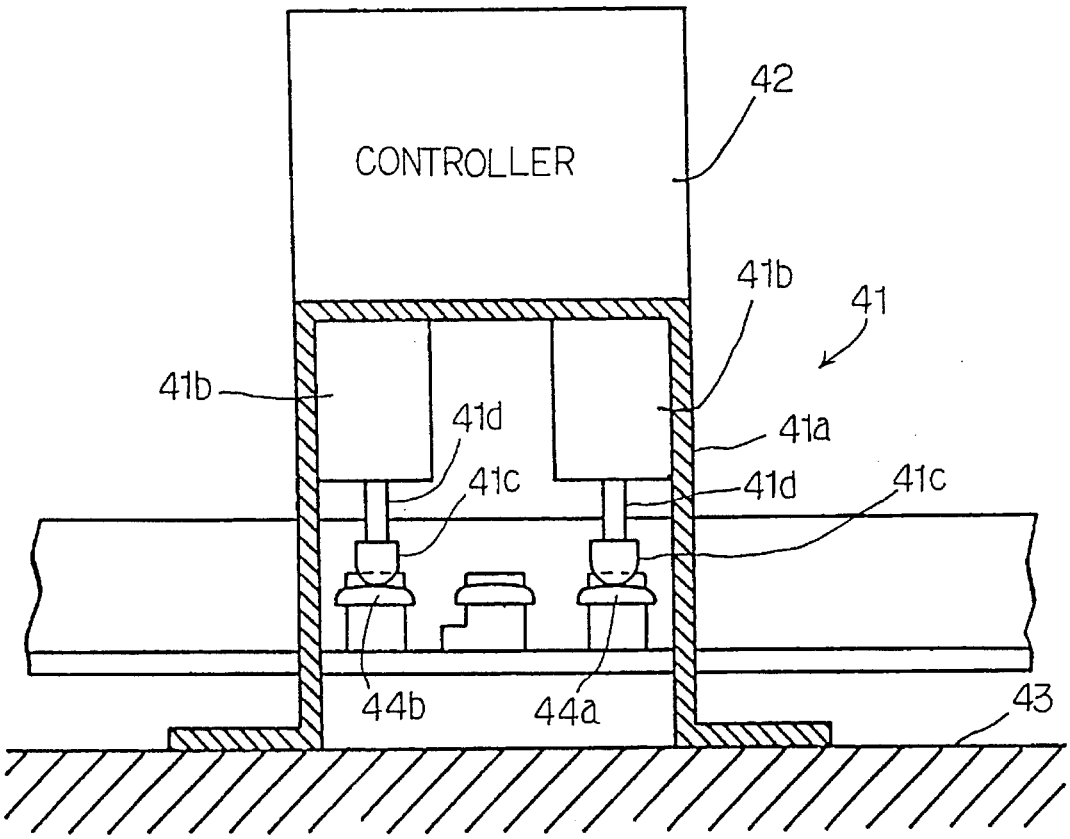
FIG. 7 is a front view showing yet another pedal actuator unit according to the present invention.

Turning to FIG. 7 of the drawings, yet another pedal actuator unit 41 is illustrated together with a control box 42 and pedal mechanisms of an upright piano.

The pedal actuator unit 41 forms a part of an automatic playing apparatus embodying the present invention together with a controlling unit and a key actuator unit. The key actuator unit and the controlling unit are similar to those of the first embodiment, and are not described in detail.

The control box 42 accommodates the controlling unit, and the total weight is about 15 kilograms in this instance. The pedal actuator unit 41 comprises a frame 41*a* directly placed on a floor 43 and a plurality of solenoid-operated actuators 41*b*, and the control box 42 is mounted on the frame 41*a*. The pushers 41*c* are attached to the plungers 41*c* of the solenoid-operated actuators 41*b*, and are held in contact with a damper pedal 44*a* and a soft pedal 44*b* of the upright piano.

The reaction of each pedal 44*a*/44*b* is assumed to be 528 kilograms, and the total reaction, i.e., 10 kilograms is less than the weight of the control box 42. For this reason, even if the frame 41*a* is separated from the piano case of the upright piano, the relative position between the pedal actuator unit 41 and the damper and soft pedals 44*a* and 44*b* is not changed.

The automatic playing apparatus implementing the third embodiment achieves all of the advantages of the first embodiment.

Although particular embodiments of the present invention have been shown and described, it will be obvious to those skilled in the art that various changes and modifications may be made without departing from the spirit and scope of the present invention. For example, the automatic playing apparatus may be a build-in type having the pedal actuator unit 10*b*/31 placed inside of the piano case.

What is claimed is:

1. An automatic playing apparatus associated with an acoustic piano having a plurality of keys each movable from a rest position to an end position for causing music strings to produce an acoustic sound, pedal mechanisms for imparting effects to said acoustic sound and a piano case for accommodating said plurality of keys and said pedal mechanisms, comprising:

a) a key actuator unit having a plurality of solenoid-operated actuators respectively associated with said plurality of keys for moving the associated keys;

b) a pedal actuator unit having a plurality of solenoid-operated actuators respectively associated with said pedal mechanisms for actuating the associated pedal mechanisms, wherein said pedal actuator unit is supported by a frame which is independent of said piano case so as to isolate said piano case from said pedal actuator unit during actuation of each of said pedal mechanisms; and c) a controller unit operative to produce drive pulse signals, and selectively supplying said drive pulse signals to said plurality of solenoid-operated actuators of said key actuator unit and said plurality of solenoid-operated actuators of said pedal actuator unit.

2. The automatic playing apparatus as set forth in claim 1, in which said key actuator unit, the pedal actuator unit and the controlling unit are provided outside of said piano case, and said key actuator unit and said pedal actuator unit are set to respective positions close to said keyboard and said pedal mechanisms.

3. The automatic playing apparatus as set forth in claim 2, in which said pedal actuator unit further has a frame directly placed on a place where said acoustic piano is also placed, said plurality of solenoid-operated actuators being supported by said frame, and a means for fixing a relative position between said frame and said acoustic piano.

4. The automatic playing apparatus as set forth in claim 3, in which said means is implemented by a wedge member inserted between a lower surface of a bottom board of said acoustic piano and an upper surface of said frame.

5. The automatic playing apparatus as set forth in claim 3, in which said means is implemented by a plurality of screws pressed against said place for pressing an upper surface of said frame against a lower surface of a pedal box of said acoustic piano.

6. The automatic playing apparatus as set forth in claim 3, in which said means is implemented by a box mounted on said frame, said box having a weight larger than the total reaction of said pedal mechanisms produced when said plurality of solenoid-operated actuators actuate said medal mechanisms, respectively.

* * * * *